US005224602A

United States Patent [19]

Bettles et al.

[11] Patent Number: 5,224,602

[45] Date of Patent: Jul. 6, 1993

[54] COMBINATION BASEBALL AND BAT CARRYING CASE, BAT RACK AND BALL DISPENSER

[76] Inventors: Christopher J. Bettles, 14119 - 73A Avenue, Surrey, British Columbia, Canada, V3W 7K8; Ronald M. Buller, 12397 Boundary Drive South, Surrey, British Columbia, Canada, V3X 2C6; David G. Fiskar, No. 5, 21541 Mayo Place, Maple Ridge, British Columbia, Canada, V2X 2L1

[21] Appl. No.: 893,661

[22] Filed: Jun. 5, 1992

[51] Int. Cl.[5] ..... A45F 5/00; B65D 85/00

[52] U.S. Cl. ..... 206/579; 206/315.1; 206/315.9; 294/143; 294/146; 211/60.1

[58] Field of Search ..... 206/315.9, 315.1, 579; 294/141, 143, 146, 159, 160; 211/60.1, 167

[56] References Cited

U.S. PATENT DOCUMENTS

| | | | |
|---|---|---|---|
| 1,541,895 | 6/1925 | Blair . | |
| 2,501,270 | 3/1950 | Fleming | 224/48 |
| 2,889,863 | 6/1959 | Arnold, Jr. | 150/1.5 |
| 2,964,166 | 12/1960 | Lehner et al. | 206/1 |
| 3,014,733 | 12/1961 | Higginbotham | 211/60.1 X |
| 3,819,038 | 6/1974 | Candor et al. | 206/579 |
| 3,830,362 | 8/1974 | Tassone et al. | 206/223 |
| 3,848,737 | 11/1974 | Kenon | 206/315.9 X |
| 3,933,241 | 1/1976 | Tassone et al. | 206/315.9 X |
| 4,014,416 | 3/1977 | Golden | 190/42 |
| 4,049,126 | 9/1977 | Halverson | 294/143 X |
| 4,193,495 | 3/1980 | Keeley | 294/143 |
| 4,262,798 | 4/1981 | Raab | 206/315 |
| 4,595,226 | 6/1986 | Wessel | 294/146 |
| 4,643,302 | 2/1987 | Baumgardner | 206/315.1 |
| 4,807,763 | 2/1989 | Jankovsky | 211/60.1 |
| 4,842,134 | 6/1989 | Chang | 206/315.1 |
| 4,890,731 | 1/1990 | Mroz | 206/315.9 |
| 4,951,816 | 8/1990 | Smith | 206/279 |
| 4,968,048 | 11/1990 | Lortie | 206/315.1 X |

*Primary Examiner*—Steven N. Meyers
*Assistant Examiner*—Jacob K. Ackun, Jr.
*Attorney, Agent, or Firm*—Klarquist, Sparkman, Campbell, Leigh & Whinston

[57] ABSTRACT

A case for carrying baseball bats and balls and which also serves as a bat rack and ball dispenser when opened at the playing field is disclosed. A rigid hinged case has bat racks which maintain the bats in parallel relationship when the case is being carried, and a gravity feed ball dispenser.

9 Claims, 4 Drawing Sheets

COMBINATION BASEBALL AND BAT CARRYING CASE, BAT RACK AND BALL DISPENSER

FIELD OF THE INVENTION

The invention relates to baseball equipment, and more particularly to a case for carrying and storing baseballs or softballs and bats, and which converts to a bat rack and ball dispenser.

BACKGROUND OF THE INVENTION

A baseball team will generally carry with it to the baseball diamond at least four or more bats and half a dozen or more baseballs. A variety of bats is required due to differing preferences of the players, and multiple balls are needed for warm-up purposes. Typically the bats and balls are carried loosely in a duffle bag. A player who wishes to use a particular bat will rummage through the duffle bag to find it. During the game the bats will be leaned against the backstop between uses. At the end of the game the bats and balls are gathered and returned to the duffle bag. Bats and particularly balls are difficult to locate during the game and are easily misplaced in this way. Also, the bats will bang against one another when carried in the duffle bag, which can cause damage or metal fatigue in bats made of metal or synthetic materials.

Various carrying cases have been devised for baseball bats. For example, U.S. Pat. No. 4,890,731 issued Jan. 2, 1990 to Mroz discloses a rigid case for carrying three or six bats. In one embodiment the bats are secured in the case only when it is closed. In another embodiment, the bats are loaded from either side of the case and secured by straps. In either embodiment, the case cannot serve as a bat rack from which bats can be selected and replaced during a game.

U.S. Pat. No. 2,889,863 issued Jun. 9, 1959 to Lois discloses a combined bat rack and carrier which is formed of a long flexible sheet with a number of pockets to receive the bats. Grommets are provided in the flexible material to permit the sheet to be hung up. To carry the bats, the sheet is folded up to retain the bats within the folded sheet. This device lacks the advantages of a solid case which does not require folding, and is not equipped to store balls.

There is therefore a need for a bat carrying case which has the advantages and convenience of a solid case and also functions as a bat rack which can be suspended from the backstop, and also serves to store and dispense balls.

SUMMARY OF THE INVENTION

The invention provides a combined bat rack and carrying case comprising a rigid, hollow casing comprising two hinged casing halves pivotable between open and closed positions; handle means for carrying the casing in the closed position; closure means for securing the casing in the closed position; a bat rack for suspending a plurality of bats mounted in the interior of the casing; and partition means in the interior of the casing for maintaining the bats in parallel relationship. According to one aspect of the invention, the combination bat carrying case and bat rack further comprises a gravity feed ball storage chamber, aligned parallel to the bats, having a vertically extending chamber, ball entry and ball removal apertures. According to a further aspect of the invention, the combination bat carrying case and bat rack further comprises hook means attached to the casing for supporting the casing in the open position on a chain-link backstop. In another embodiment of the invention, the combination bat carrying case and bat rack comprises folding legs attached to the casing for supporting the casing in the open position on a horizontal plane.

BRIEF DESCRIPTION OF THE DRAWINGS

In drawings which illustrate a preferred embodiment of the invention.

DETAILED DESCRIPTION OF THE PREFERRED EMBODIMENT

Figure 1:
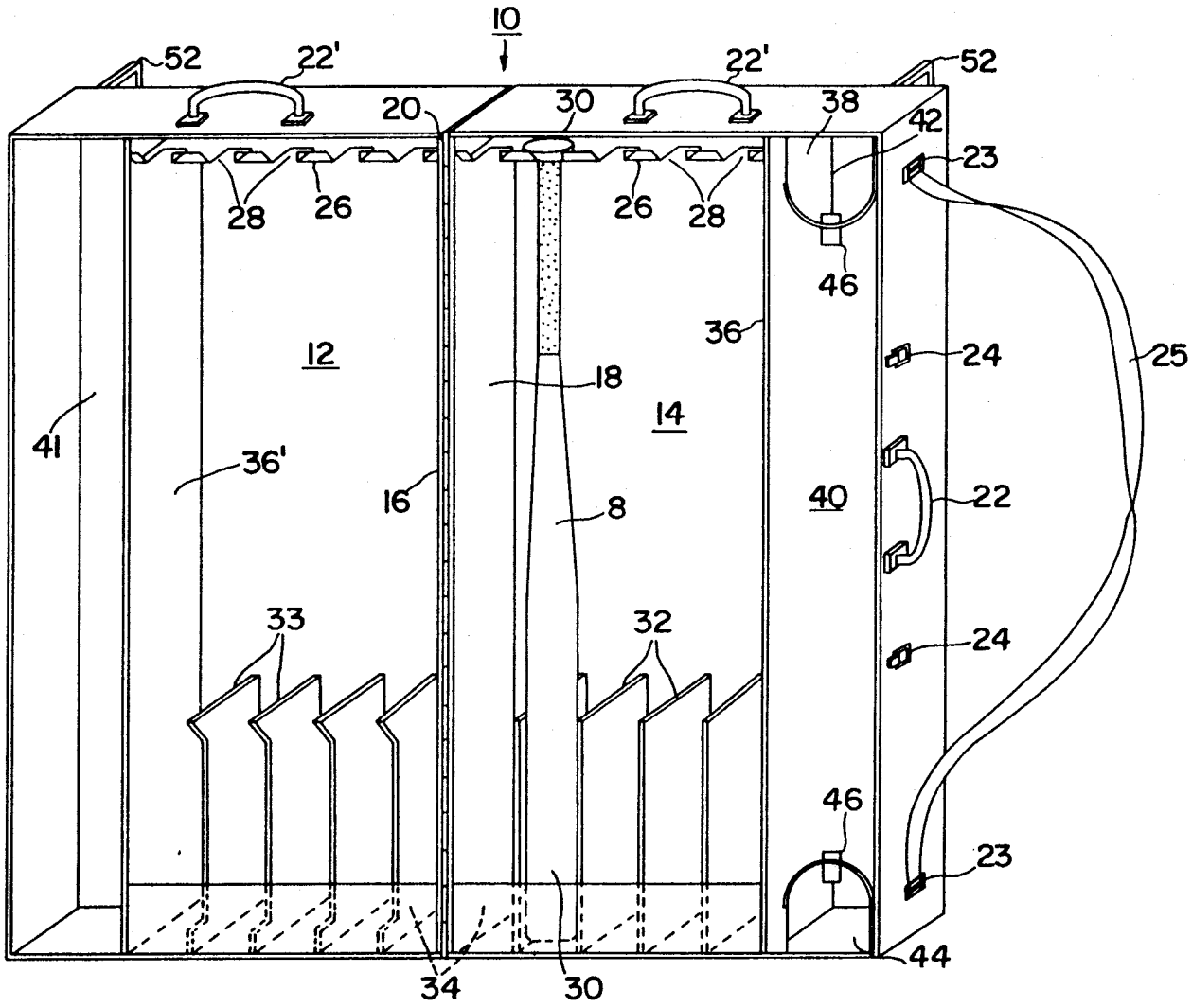
FIG. 1 is a perspective view of the combination carrying case/bat rack of the invention in open configuration.

With reference to the drawings, the carrying case/bat rack is designated generally as 10, and carries baseballs or softballs 6 (referred to sometimes collectively as "baseballs") and bats 8. It consists of hard, moulded plastic case halves 12 and 14 which are hinged by hinge 20 along edges 16, 18 to permit the case halves to be opened, as in FIG. 1, or closed as in FIG. 2. The case 10 is provided with standard handles 22 and clasps 24 to permit it to be readily carried in the closed position and handles 22' which permit the case to be readily lifted when in the open position, for hanging on a backstop. Tabs 23, may also be provided to which shoulder-carrying straps 25 could be attached.

Bat racks 26 extend across the upper interior of case halves 12, 14. Each rack 26 has a number of cutouts 28, preferably 5 per side, which are wide enough to receive the narrowest part of the neck of bat 8, but narrower than the butt end 30 of the bat. The lower interior of halves 12 and 14 are provided with a number of partitions 33, 32 respectively, preferably four in number, which extend perpendicularly from the interior surface of the case in locations such that the partitions sit on either side of the fat end 30 of the bat 8 when the neck is sitting in a corresponding cutout 28 in the rack 26. Panels 34 are fixed to the front edges of the partitions 32 to prevent the fat ends 30 of bats 8 from moving significantly when the case is closed and being carried by handles 22.

A further partition 36 forms a ball-receiving channel 38 along one edge of the case. Channel 38 has a rounded convex front panel 40 provided with openings 42, 44 which are large enough to receive a hardball (3 inches in diameter) or a soft ball (3¾ inches in diameter) depending on the desired function of the case. Flexible plastic strips 46 are secured at points extending into openings 42, 44 to hold a ball in place in the openings until pressure is applied to the ball to remove it by a hand. Convex front panel 40 extends into channel 41 formed in the case half 12 by partition 36' when the case is closed.

Figure 2:
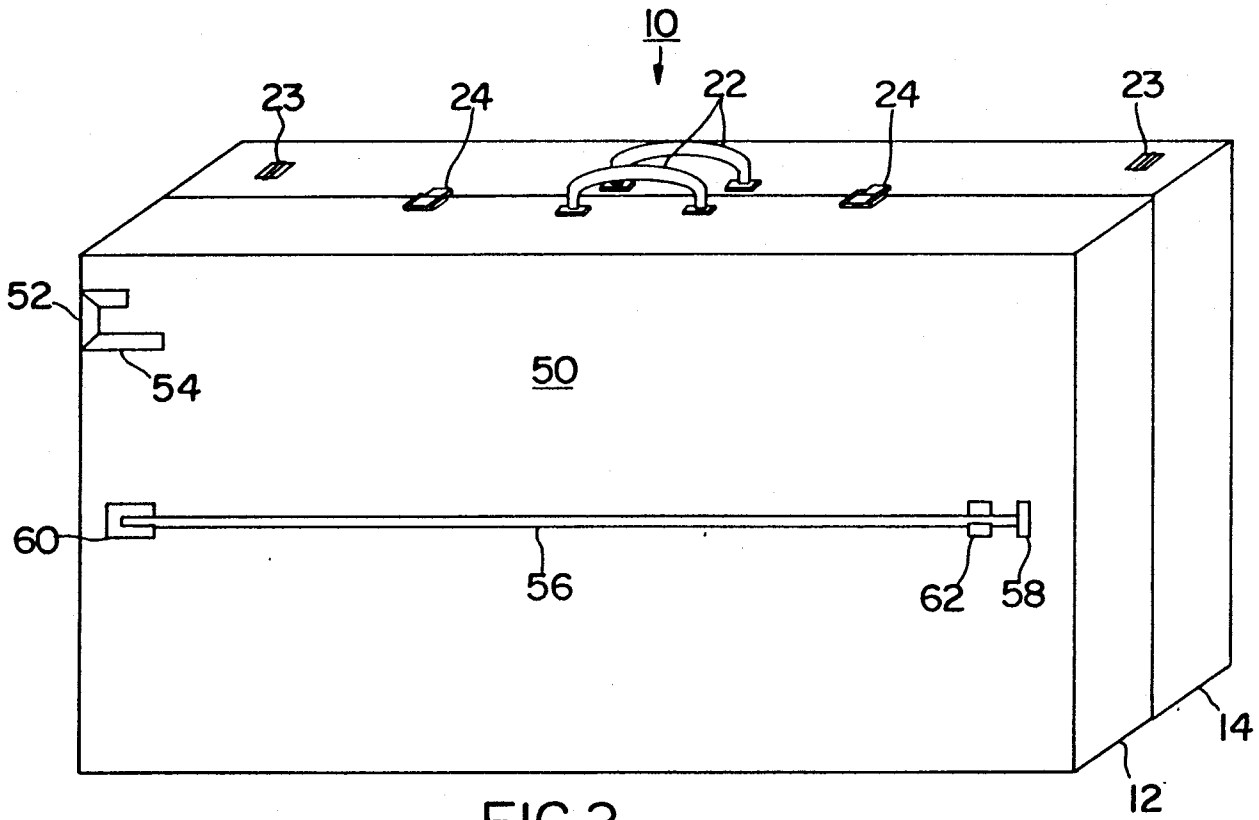
FIG. 2 is a perspective view of the combination carrying case/bat rack of the invention in closed carrying case configuration.

The outer panels 48, 50 of the case 10 are provided with hooks 52 which are designed to be hooked over the mesh of a baseball diamond backstop to permit the case to be hung on the backstop while in the open configuration shown in FIG. 1. Hooks 52 can either be hinged at 54 to permit them to lie flat against the case 10 when not in use (as in FIG. 2), or can be designed to retract into the interior of the case when not in use.

Figure 3:
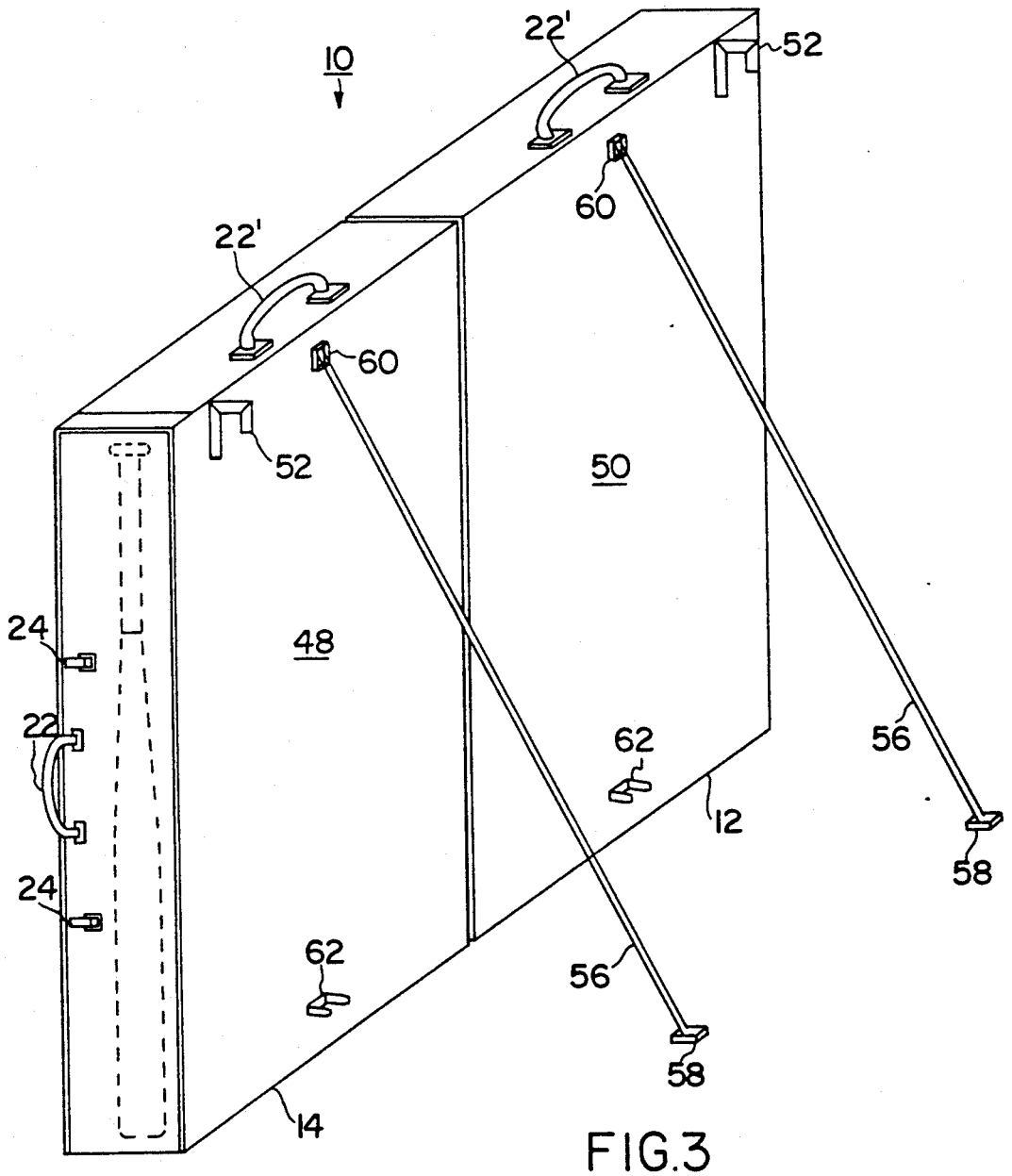
FIG. 3 is a rear perspective view of the combination carrying case/bat rack of the invention in upstanding bat rack configuration.

The outer panels 48, 50 of the case 10 can also be provided with hinged legs 56 which can be extended as in FIG. 3, with pivotable feet 58 and hinged ends 60, to support the open case/bat rack in an upright position without the necessity of a backstop. For carrying purposes, the legs are held against the case by resilient grips 62, and are preferably recessed into the outer wall of the case when not in use.

In operation, the case 10 is opened, so that bats can be loaded in racks 26 and balls loaded in channel 38. The sides of the case are closed and the clasps 24 closed so that the case can be carried by handles 22 much as a suitcase or briefcase. Due to partitions 32, 33 and panel 34 the bats are kept in alignment even when held in position parallel to the ground when being carried. Also the edges of the two racks 26 are in contact in the closed position to prevent the butt ends of the bats from leaving the rack. When the case has been transported to the diamond, the hooks 52 will be extended, the case opened and lifted by handles 22' and hung on the outside of the backstop to act as a bat rack and gravity feed ball dispenser to thereby permit players to select and replace bats and balls. Upstanding edges 27 hold the bats in position when suspended vertically on the rack 26. Alternatively legs 56 can be extended and the opened case set on the ground, supported by the legs 56 to act as a bat rack and ball dispenser. When a ball is removed from opening 44, gravity causes the remaining balls to drop down chamber 38 so that the next ball is ready to be removed from aperture 44.

Figure 5:
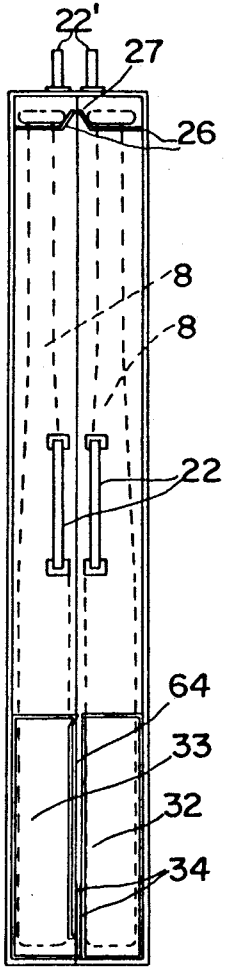
FIG. 5 is a side view of the embodiment of the invention in closed configuration as shown in FIG. 2.
Figure 4:
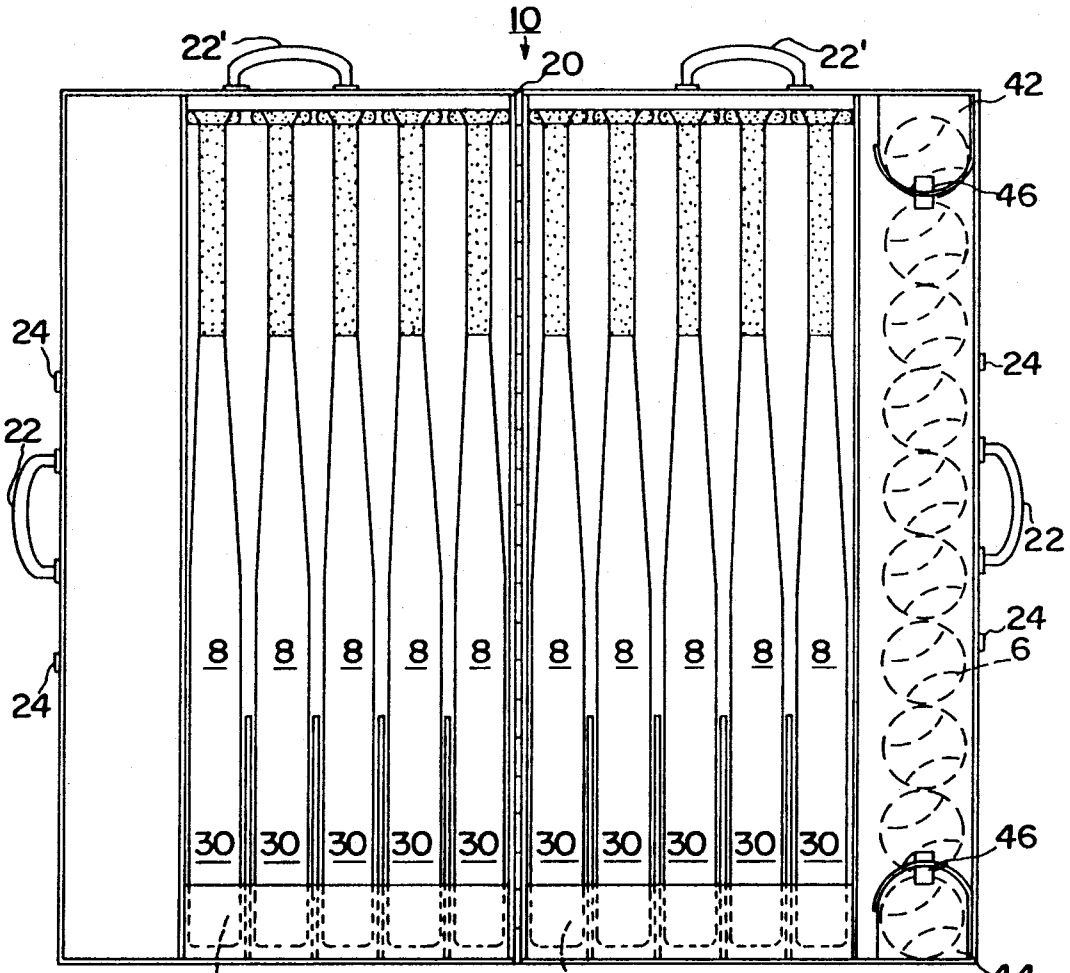
FIG. 4 is a front view of the embodiment of the invention in open configuration as shown in FIG. 3.

As shown in FIGS. 4 and 5, partitions 33 have a cut-out section 64 which provides a space behind panel 34 to hold a score sheet for use while the bat rack is in the open position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A combination bat carrying case and back rack comprising:

a) a rigid, hollow casing comprising two hinged casing have pivotable between open an closed positions, each said casing half having a horizontal top panel and a vertical side panel when standing in said open position;

b) handle means secured to at least one of said vertical panels for carrying said casing in the closed position;

c) closure means for securing said casing in the closed position;

d) a bat rack for suspending a plurality of bats mounted in the interior of said casing; and e) means for partitioning the interior of said casing for maintaining said bats in parallel relationship.

2. The combination bat carrying case and bat rack of claim 1 further comprising hook means attached to said casing for supporting said casing in the open position on a chain-link backstop.

3. The combination bat carrying case and bat rack of claim 1 further comprising two legs pivotally attached to the outside of said casing for supporting said casing in the open position on a horizontal surface.

4. The combination bat carrying case and bat rack of claim 1 further comprising a gravity feed ball storage chamber, aligned parallel to said bats, having a vertically extending chamber, ball entry and ball removal apertures.

5. The combination bat carrying case and bat rack of claim 1 wherein each half of said carrying case comprises a bat rack.

6. The combination bat carrying case and bat rack of claim 2 wherein said hook means hingedly connected to said case whereby said hook means is adapted to be movable between a first position in which said hook means extends perpendicularly to said case and a second position in which said hook means lies closely adjacent to said case.

7. The combination bat carrying case and bat rack of claim wherein said handle means comprises a shoulder strap.

8. The combination bat carrying case and bat rack of claim 1 further comprising a panel for securing a score sheet when said casing is in the open position.

9. The combination bat carrying case and bat rack of claim 2 further comprising handle means secured to the top of said casing halves for lifting said casing when said casing is in said open position.

* * * * *